US010813177B2

(12) United States Patent
Park et al.

(10) Patent No.: US 10,813,177 B2
(45) Date of Patent: Oct. 20, 2020

(54) COOKING APPARATUS AND METHOD OF CONTROLLING THE SAME

(71) Applicant: Samsung Electronics Co., Ltd., Suwon-si (KR)

(72) Inventors: Nam Ju Park, Suwon-si (KR); Ji Woong Choi, Yongin-si (KR); Sang Hyun Kang, Yongin-si (KR); Se Bin Im, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 406 days.

(21) Appl. No.: 15/692,022

(22) Filed: Aug. 31, 2017

(65) Prior Publication Data

US 2018/0063897 A1 Mar. 1, 2018

(30) Foreign Application Priority Data

Sep. 1, 2016 (KR) ..... 10-2016-0112876

(51) Int. Cl.
*H05B 6/06* (2006.01)
*H05B 6/12* (2006.01)
*F24C 7/08* (2006.01)

(52) U.S. Cl.
CPC ..... *H05B 6/1272* (2013.01); *H05B 6/062* (2013.01); *H05B 6/065* (2013.01); *F24C 7/083* (2013.01);
(Continued)

(58) Field of Classification Search
CPC ..... H05B 6/062; H05B 6/1272; H05B 6/065; H05B 2213/05; H05B 2206/022; F24C 7/088; F24C 7/083
(Continued)

(56) References Cited

U.S. PATENT DOCUMENTS 7,973,268 B2 7/2011 Miyauchi et al.
2001/0023868 A1 9/2001 Aurre et al.
(Continued)

FOREIGN PATENT DOCUMENTS

EP 2034801 3/2009
EP 2360989 8/2011
(Continued)

OTHER PUBLICATIONS

European Communication under Rule 71(3) EPC dated Jul. 11, 2018 in European Patent Application No. 17188650.0.
(Continued)

*Primary Examiner* — Quang T Van
(74) *Attorney, Agent, or Firm* — Staas & Halsey LLP

(57) ABSTRACT

A cooking apparatus includes a coil configured to generate a magnetic field, a driver including a first switch and a second switch and configured to change a direction of the current, a current detector configured to detect the current of the coil, a controller configured to increase a duty cycle of the first switch during a reference time when an operation start signal is transmitted thereto, control operations of the first switch and the second switch on the basis of an operating frequency when the reference time elapses, check zero cross points of currents detected while the first switch and the second switch are operated, compare a time point of the checked zero cross point to a starting time point of an turn-on operation of the first switch to determine a material of the vessel, and block the applied current when the vessel is determined to be a non-heatable vessel.

14 Claims, 15 Drawing Sheets

(52) U.S. Cl.
CPC ..... *F24C 7/088* (2013.01); *H05B 2206/022* (2013.01); *H05B 2213/05* (2013.01)

(58) Field of Classification Search
USPC ..... 219/624, 625, 620, 619, 661–665, 667, 219/674; 363/37, 67, 80, 97; 399/67, 69, 399/88, 328–332, 334
See application file for complete search history.

(56) References Cited

U.S. PATENT DOCUMENTS

| | | | | |
|---|---|---|---|---|
| 2005/0087526 | A1 | 4/2005 | Kim et al. | |
| 2005/0117923 | A1* | 6/2005 | Sasamoto ..... | G03G 15/2039 399/45 |
| 2007/0102420 | A1* | 5/2007 | Miyauchi ..... | H05B 6/062 219/626 |
| 2007/0278216 | A1 | 12/2007 | Tominaga et al. | |
| 2012/0152934 | A1 | 6/2012 | Kondo | |
| 2012/0285948 | A1 | 11/2012 | Shan et al. | |
| 2013/0320000 | A1 | 12/2013 | Shan et al. | |

FOREIGN PATENT DOCUMENTS

| | | |
|---|---|---|
| JP | 2007-184180 | 7/2007 |
| KR | 10-1996-0028699 | 7/1996 |
| KR | 10-1999-0002750 | 1/1999 |
| WO | 2014/016032 | 1/2014 |

OTHER PUBLICATIONS

Extended European Search Report dated Jan. 24, 2018 in European Patent Application No. 17188650.0.
International Search Report dated Nov. 29, 2017 in International Patent Application No. PCT/KR2017/009548.

* cited by examiner

FIG. 5C

| DETERMINATION CRITERION | | | DETERMINATION |
|---|---|---|---|
| AMOUNT OF CHANGE OF PHASE DIFFERENCE | < | REFERENCE PHASE DIFFERENCE AMOUNT OF CHANGE | PRESENCE OF VESSEL |
| AMOUNT OF CHANGE OF PHASE DIFFERENCE | ≥ | REFERENCE PHASE DIFFERENCE AMOUNT OF CHANGE | ABSENCE OF VESSEL |

COOKING APPARATUS AND METHOD OF CONTROLLING THE SAME

CROSS-REFERENCE TO RELATED APPLICATIONS

This application claims the benefit of Korean Patent Application No. 10-2016-0112876, filed on Sep. 1, 2016 in the Korean Intellectual Property Office, the disclosure of which is incorporated herein by reference.

BACKGROUND

1. Field

Embodiments of the present disclosure relate to a cooking apparatus configured to determine a material of a vessel and reduce noise thereof, and a method of controlling the same.

2. Description of the Related Art

Generally, cooking apparatuses are apparatuses for heating and cooking foods, and are largely divided into an apparatus using a method in which heat for heating food is generated by using electricity and an apparatus using a method in which heat for heating food is generated by burning gas.

Such cooking apparatuses may be divided into a gas range, an oven, an electric range, and the like.

Examples of the electric range include a highlight electric range for directly heating a heating element by using electricity, an induction heating electric range (i.e., an induction cooker) for generating heat in a vessel by a magnetic field formed in a coil, a hot plate for heating a coil type electrothermal wire under a cast iron or a coated hot plate, a halogen electric range for heating a cooking vessel with far infrared ray power generated by a halogen lamp, and the like.

The induction heating electric range among the above electric ranges can heat the vessel only when a magnetic vessel is placed at a position corresponding to a coil inside a main body of the induction heating electric range.

That is, in the induction heating electric range, there is a problem in that food in the placed vessel is not cooked even when a current is applied to the coil when the vessel is not or only slightly magnetic.

Therefore, the induction heating electric range needs to determine a material of the placed vessel when a cooking command is input and inform a user of whether the vessel can be heated.

SUMMARY

Therefore, it is an aspect of the present disclosure to provide a cooking apparatus configured to gradually increase a duty cycle of a first switch from a first duty cycle to a reference duty cycle during a reference time when the cooking apparatus receives an operation start signal, allow a current of a coil to be gradually increased, and reduce noise around the coil, and a method of controlling the same.

It is another aspect of the present disclosure to provide a cooking apparatus configured to check a zero cross point of a current detected while a frequency is applied to a first switch and determine a material of a vessel by comparing a starting time point of the checked zero cross point to a starting time point of a turn-on operation of the first switch, and the method of controlling the same.

Additional aspects of the disclosure will be set forth in part in the description which follows and, in part, will be obvious from the description, or may be learned by practice of the disclosure.

In accordance with one aspect of the present disclosure, a cooking apparatus includes a coil configured to place a vessel thereon and generate a magnetic field when a current is applied thereto, a driver including a first switch and a second switch and configured to change a direction of the current by alternately operating the first and second switches, a current detector configured to detect the current of the coil, and a controller configured to gradually increase a duty cycle of the first switch from a first duty cycle to a second duty cycle during a reference time when an operation start signal is transmitted thereto, control operations of the first switch and the second switch on the basis of an operating frequency when the reference time elapses, compare a phase of a voltage input to the first switch to a phase of the detected current, and determine a material of the vessel.

A half-cycle signal of one cycle signal of the operating frequency may be a signal for turning on the first switch, the remaining half-cycle signal may be a signal for turning on the second switch, and the half-cycle signal for turning on the first switch may have the second duty cycle.

The controller may compare a phase of a voltage at a time point at which the first switch is turned on to a phase of a zero cross point of the detected current when determining the material of the vessel.

When the vessel is a non-heatable vessel, the controller may control the current applied to the coil to be blocked and control an output of non-heatable information of the vessel.

The controller may compare a phase at a time point of a zero cross point of the checked current to a phase at a starting time point of the turn-on operation of the first switch, obtain a phase difference therebetween, and determine the material of the vessel on the basis of the obtained phase difference.

The controller may control the operations of the first switch and the second switch on the basis of a different operating frequency from the operating frequency, recheck a current detected while the first switch is operated using the different operating frequency and a starting time point of a turn-on operation of the first switch, compare the phase at the time point of the zero cross point of the rechecked current to a phase at the rechecked starting time point of the turn-on operation of the first switch, re-obtain a phase difference therebetween, and determine the material of the vessel on the basis of the re-obtained phase difference and an amount of change of the obtained phase difference.

The controller may determine that the vessel is a non-heatable vessel when the amount of change of the phase difference is greater than or equal to a reference phase difference amount of change, and determine that the vessel is a heatable vessel when the amount of change of the phase difference is smaller than the reference phase difference amount of change.

In accordance with another aspect of the present disclosure, a cooking apparatus includes a coil configured to place a vessel thereon and generate a magnetic field when a current is applied thereto, a driver including a first switch and a second switch for changing a direction of the current flowing through the coil, and a controller configured to alternately control turn-on operations of the first and second switches during a reference time such that the current applied to the coil is gradually increased when an operation start signal is transmitted thereto, wherein the controller gradually increases a duty cycle of the first switch during the reference time.

The controller may control the first switch so that a current in a first direction is applied to the coil during a turn-on time corresponding to the duty cycle of the first switch, and control the second switch so that a current in a second direction opposite to the first direction is applied to the coil during a turn-on time corresponding to a duty cycle of the second switch, and the first switch may be turned off while the second switch is turned on.

The cooking apparatus may further include a current detector configured to detect the current of the coil, and the controller may change operating frequencies for operating the first switch and the second switch at predetermined time intervals, check a zero cross point of the detected current for each of the operating frequencies, compare a phase at the zero cross point for each of the operating frequencies to a phase at a starting time point of a turn-on operation of the first switch for each operating of the frequencies, determine a material of the vessel, and block the applied current when the vessel is determined to be a non-heatable vessel.

The operating frequencies changed at the predetermined time intervals may include a first operating frequency and a second operating frequency smaller than the first operating frequency, and the controller may compare the phase at the starting time point of the turn-on operation of the first switch to the phase at the zero cross point of the detected current when the operations of the first switch and the second switch are controlled on the basis of the first operating frequency, obtain a first phase difference, compare the phase at the starting time point of the turn-on operation of the first switch to the phase at the zero cross point of the detected current when the operations of the first switch and the second switch are controlled on the basis of the second operating frequency, obtain a second phase difference, and determine the material of the vessel on the basis of an amount of change of a phase difference between the first phase difference and the second phase difference.

The controller may determine that the vessel is a non-heatable vessel when the amount of change of the phase difference is greater than or equal to a reference phase difference amount of change and determine that the vessel is a heatable vessel when the amount of change of the phase difference is smaller than the reference phase difference amount of change.

The controller may control the first operating frequency and the second operating frequency to be generated in a plurality of cycles, obtain a first current waveform in one cycle of currents detected when the first operating frequency is generated in the plurality of cycles, obtain a second current waveform of one cycle of currents detected when the second operating frequency is generated in the plurality of cycles, and check a zero cross point in each of the first current waveform and the second current waveform.

The cooking apparatus may further include a current detector configured to detect the current of the coil, and the controller may change operating frequencies for operating the first switch and the second switch at predetermined time intervals, check the detected current for each of the operating frequencies, compare the currents of the operating frequencies, and determine a material of the vessel.

A half-cycle signal of one cycle signal of the operating frequency may be a signal for turning on the first switch, the remaining half-cycle signal may be a signal for turning on the second switch, and a time for which the first switch is turned on may be the same as a time for which the second switch is turned on.

In accordance with still another aspect of the present disclosure, a method of controlling a cooking apparatus including a coil configured to place a vessel thereon and a first switch and a second switch configured to change a direction of a current applied to the coil, the method includes gradually increasing a duty cycle of the first switch from a first duty cycle to a second duty cycle during a reference time when an operation start signal is transmitted to the cooking apparatus, operating the first switch and the second switch on the basis of a plurality of different operating frequencies at predetermined time intervals when the reference time elapses, checking a zero cross point of a detected current for each of the operating frequencies, comparing a phase at the zero cross point for each of the operating frequencies to a phase at a starting time point of a turn-on operation of the first switch for each of the operating frequencies, and determining a material of the vessel, and blocking the applied current when the vessel is determined to be a non-heatable vessel.

The plurality of operating frequencies may include a first operating frequency and a second operating frequency smaller than the first operating frequency, and the checking of the zero cross point of the detected current for each of the operating frequencies may include detecting the current applied to the coil while the first switch is operated using the first operating frequency, checking a phase at a first zero cross point of the detected current, detecting the current applied to the coil while the first switch is operated using the second operating frequency, and checking a phase at a second zero cross point of the detected current.

The determining of the material of the vessel may include comparing the phase at the starting time point of the turn-on operation of the first switch to the phase at the first zero cross point while the first switch is operated using the first operating frequency, obtaining a first phase difference, comparing the phase at the starting time point of the turn-on operation of the first switch to the phase at the second zero cross point while the first switch is operated using the second operating frequency, obtaining a second phase difference, checking an amount of change of a phase difference between the first phase difference and the second phase difference, and determining the material of the vessel on the basis of the checked amount of change of the phase difference.

The determining of the material of the vessel may include determining that the vessel is a non-heatable vessel when the amount of change of the phase difference is greater than or equal to a reference phase difference amount of change, and determining that the vessel is a heatable vessel when the amount of change of the phase difference is smaller than the reference phase difference amount of change.

The gradually increasing of the duty cycle of the first switch from the first duty cycle to the second duty cycle may include applying a current in a first direction to the coil during a turn-on time corresponding to the duty cycle of the first switch, applying a current in a second direction opposite to the first direction to the coil during a turn-on time corresponding to the duty cycle of the second switch, and gradually increasing the current applied to the coil on the basis of a change of the duty cycle of the first switch.

The gradually increasing of the duty cycle of the first switch from the first duty cycle to the second duty cycle may include checking multiple increases of the duty cycle and an increase rate for each of the multiple increases, and gradually increasing the duty cycle from the first duty cycle to the second duty cycle on the basis of the increase rate corresponding to each of the multiple increases.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 5C is a view illustrating an example of a vessel determination of the cooking apparatus according to the embodiment;

DETAILED DESCRIPTION

Hereinafter, the present disclosure will be described in detail with reference to the accompanying drawings.

Figure 1:
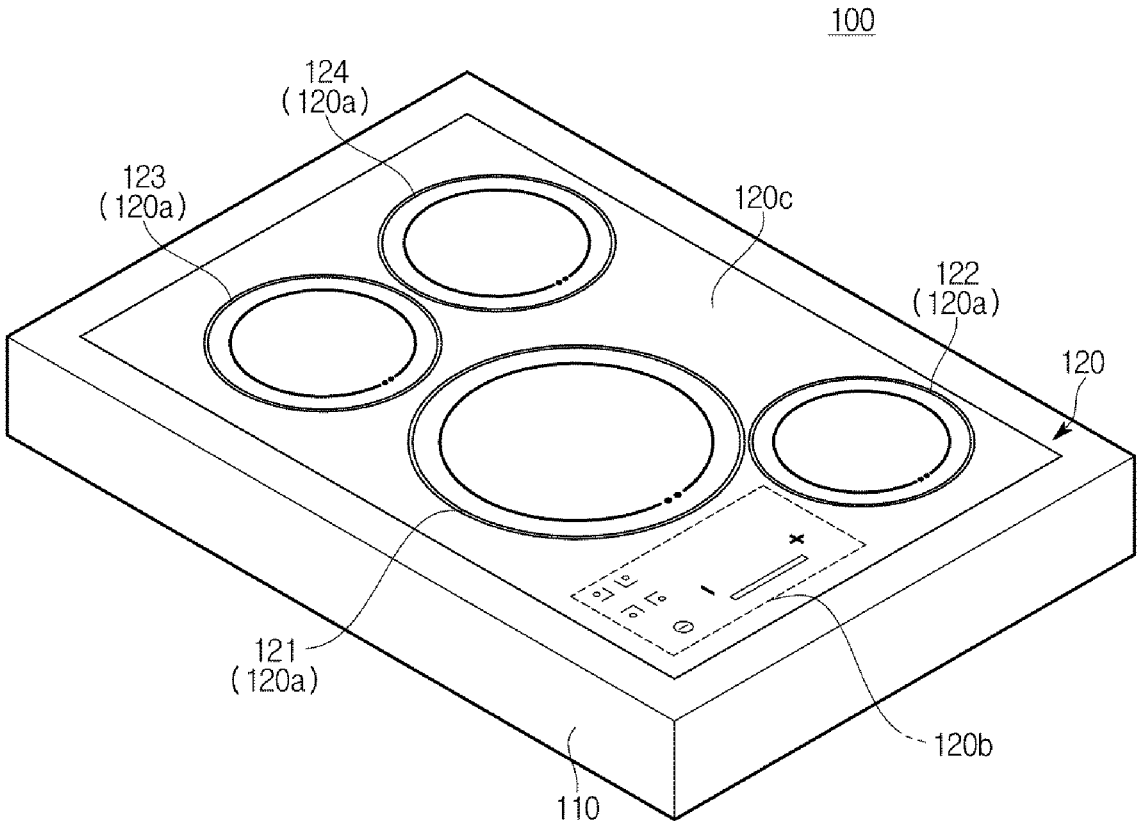
FIG. 1 is a view illustrating an example of an exterior of a cooking apparatus according to an embodiment.
Figure 2:
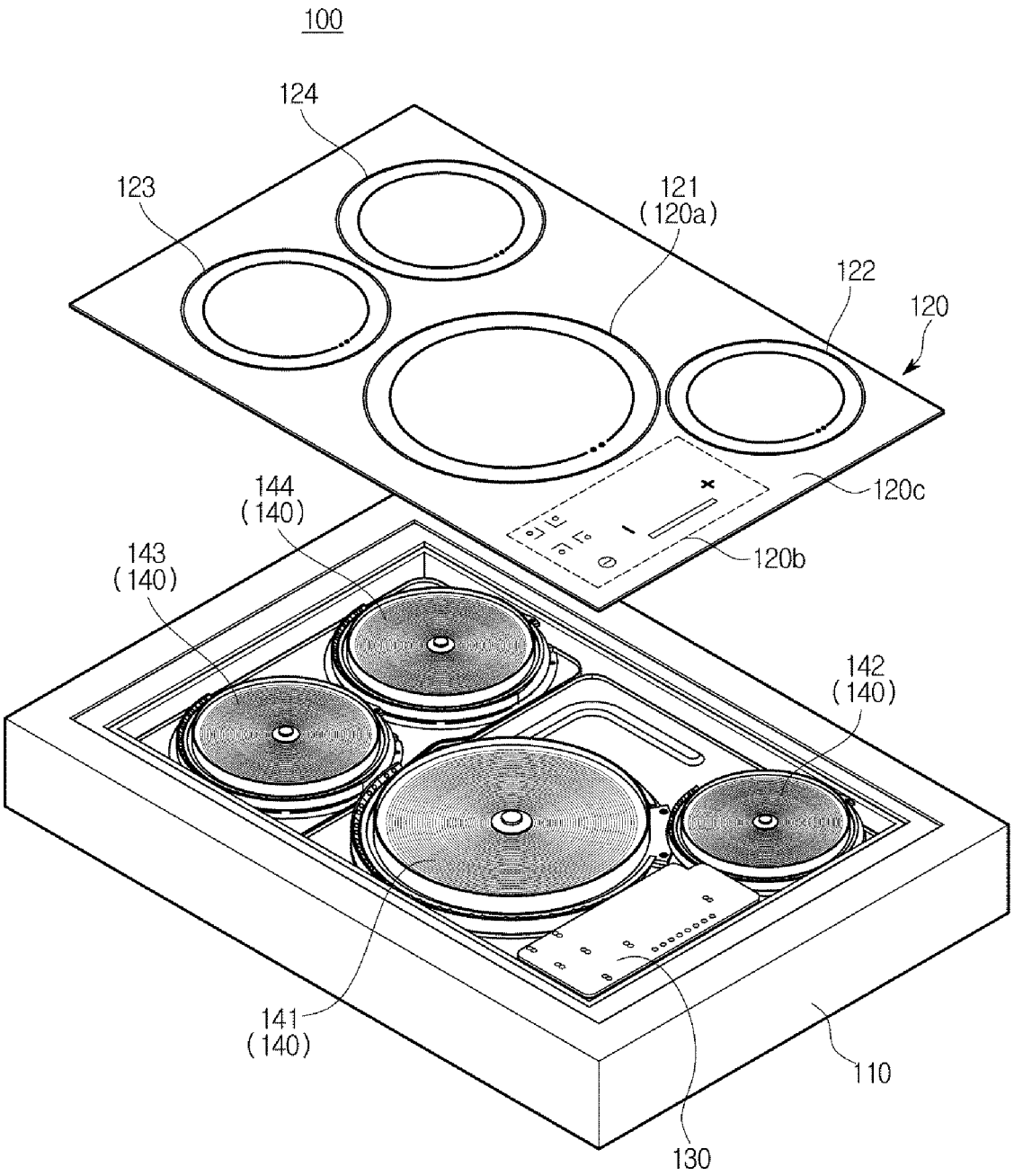
FIG. 2 is a view illustrating an example of an interior of the cooking apparatus according to the embodiment.
Figure 3:
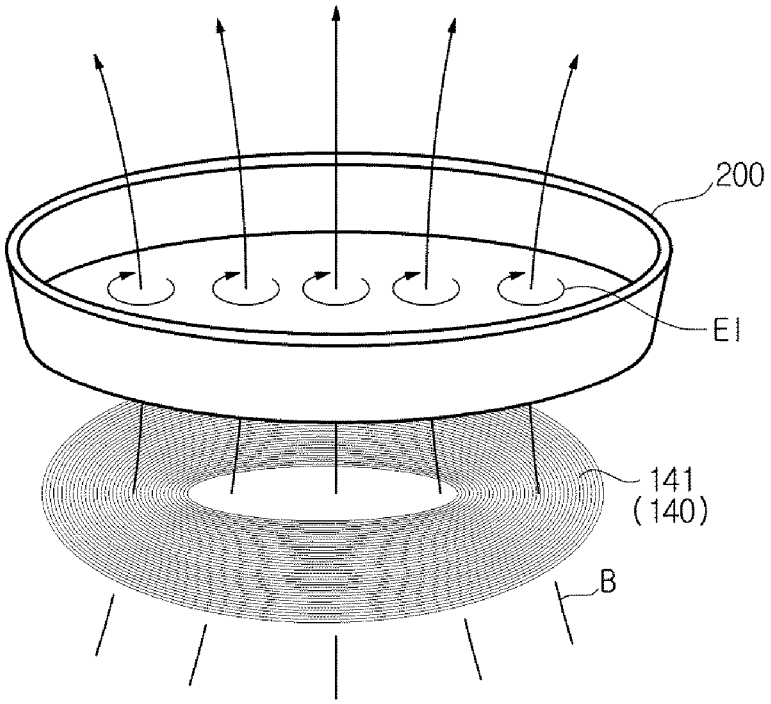
FIG. 3 is a view illustrating an example of a principle of heating a vessel inside the cooking apparatus according to the embodiment.

FIG. 1 is a view illustrating an example of an exterior of a cooking apparatus according to an embodiment, FIG. 2 is a view illustrating an example of an interior of the cooking apparatus according to the embodiment, and FIG. 3 is a view illustrating an example of a principle of heating a vessel of the cooking apparatus according to the embodiment.

As illustrated in FIG. 1, a cooking apparatus 100 includes a main body 110 configured to form an exterior of the cooking apparatus 100 and accommodate various parts constituting the cooking apparatus 100.

A cooking plate 120 having a flat plate shape is provided on an upper surface of the main body 110 such that a vessel may be placed thereon.

The cooking plate 120 may be made of a tempered glass such as a ceramic glass and the like not to be easily broken.

The cooking plate 120 includes first areas 120*a*, which are areas corresponding to positions of one or more coils and at which a vessel may be placed, a second area 120*b*, in which an operation command of the cooking apparatus 100 is input and from which operation information is output, and a third area 120*c*, which is an area excluding the first area 120*a* and the second area 120*b* of an entire area of the cooking plate 120.

Here, a coil position mark indicating a placing position of a vessel may be formed in the first area 120*a*, and an input and output position mark indicating an input and output position may be formed in the second area 120*b*.

As illustrated in FIG. 2, a user interface 130, coil parts 140, and a driving circuit 150 may be provided in a space under the cooking plate 120 and inside the main body 110.

The user interface 130 includes an inputter configured to receive an operation command from a user and an outputter configured to output operation information of the cooking apparatus 100.

The outputter may include at least one of a display configured to output the operation information as light or an image and a sound outputter configured to output the operation information as a sound.

The inputter of the user interface 130 may include a touch panel configured to recognize a touch position, and the display of the user interface 130 may include a display panel integrally provided with the touch panel.

That is, the user interface 130 may be provided with a touch screen having an integrated touch panel and display panel, and an image on the touch screen may be displayed to the outside through the second area 120*b* of the cooking plate 120.

The inputter of the user interface 130 may include a plurality of touch pads configured to recognize whether a touch is made, and the display of the user interface 130 may include at least one of a plurality of light-emitting diodes (LEDs) and a plurality of seven-segment displays.

The plurality of touch pads receive a touch signal by which power is turned on or off, a touch signal corresponding to a coil position selection, and a touch signal corresponding to an output level selection.

The inputter of the user interface 130 may be provided with at least one button, a switch, or at least one jog dial.

The plurality of LEDs may be provided to be adjacent to the plurality of touch pads and may display power on/off information, coil selection information, and coil output level information.

Here, light emitted from the plurality of LEDs may be transmitted through the second area 120*b* of the cooking plate 120 and output to the outside.

In the second area 120*b* of the cooking plate 120, operation command symbols indicating input positions of the operation commands may be formed, and an operation information symbol indicating a magnitude of an output level may be formed.

For example, the operation command symbol may include a power on/off symbol and a coil position symbol, and the operation information symbol may include an output level increase/decrease symbol.

The user interface 130 may be provided at various positions such as a front surface or a side surface of the main body 110.

The coil part 140 may include a plurality of coils 141, 142, 143, and 144.

Here, the plurality of coils 141, 142, 143, and 144 may be provided in an internal space of the main body 110, and may be provided at positions corresponding to coil position marks of the first area 120*a* of the cooking plate 120.

The plurality of coils 141, 142, 143, and 144 of the coil part 140 may have the same size and the same number of windings.

The plurality of coils 141, 142, 143, and 144 of the coil part 140 may have different sizes and different numbers of windings, and thus may have different maximum output levels.

The coils of the coil part 140 may be one coil.

Each of the coils of the coil part 140 forms a magnetic field when a current is supplied thereto to allow the magnetic field formed at this time to heat the vessel.

This process will be described in more detail with reference to FIG. 3.

Here, all principles in which the coils heat the vessel are the same. Therefore, a principle in which the first coil 141 of the plurality of coils heats the vessel will be described.

As illustrated in FIG. 3, the first coil 141 generates a magnetic field B passing through an inside of a coil according to Ampere's law when a current is supplied to a coiled wire thereof.

In this case, the magnetic field B generated in the first coil 141 passes through a bottom surface of a vessel 200.

A current applied to the first coil 141 is a current whose direction is changed over time, that is, an alternating current.

Accordingly, the magnetic field B generated in the first coil 141 is also changed over time.

That is, when the magnetic field B changed over time passes through an inside of the first coil 141, a current being rotated about the magnetic field B is generated inside the bottom surface of the vessel 200.

Here, the current being rotated about the magnetic field B is a current formed by a voltage generated in a direction for preventing a change of the magnetic field B of the first coil 141, and is referred to as an eddy current EI.

The bottom surface of the vessel 200 is heated by the eddy current EI.

In other words, when the eddy current EI flows through the vessel 200 having electrical resistance, heat is generated according to Ohm's law, and thus the vessel 200 may be heated.

Here, a phenomenon in which a current is induced by the magnetic field B changed over time is referred to as an electromagnetic induction phenomenon.

As described above, the cooking apparatus 100 may selectively supply a current to at least one of the plurality of coils 141, 142, 143, and 144, and may heat the vessel 200 using the magnetic field B generated by the at least one coil.

Here, the at least one coil to which the current is supplied may be a coil selected by a user or a coil disposed at a detected position when a position at which the vessel is placed is detected.

Figure 4:
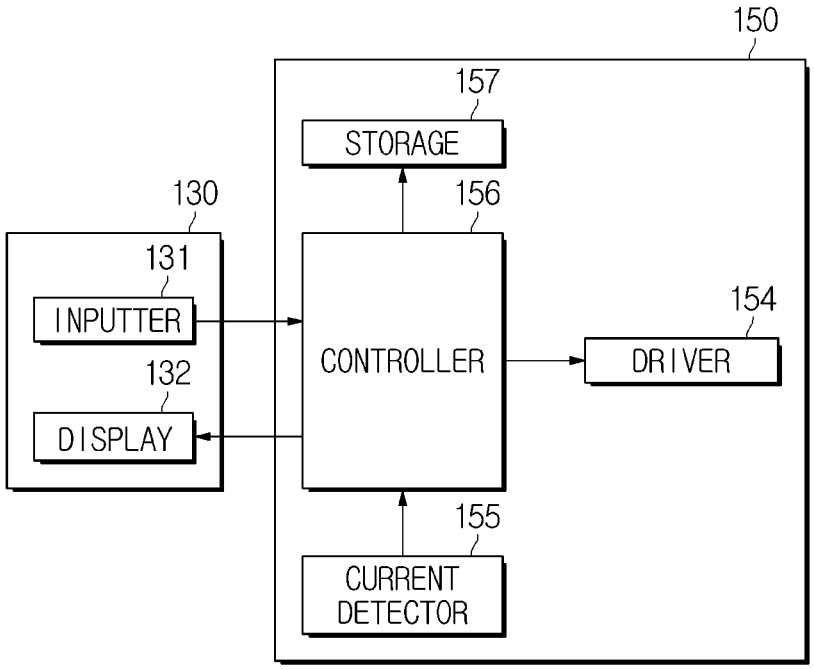
FIG. 4 is a control configuration diagram of the cooking apparatus according to the embodiment.

FIG. 4 is a control configuration diagram of the cooking apparatus according to the embodiment.

As illustrated in FIG. 4, the cooking apparatus 100 includes the user interface 130, the coil part 140, and the driving circuit 150.

The user interface 130 includes the inputter 131 configured to receive an operation command of the cooking apparatus 100 and the display 132 configured to output operation information of the cooking apparatus 100.

Here, the operation command may include a power on/off command, a coil selection command (i.e., a cooking position selection command), a coil output level selection command, an operation start command, and an operation reservation command, and the operation information may include power on/off information, coil selection information, coil output level information, and cooking progress information.

When power is turned on and a position selection signal and an operation start signal of at least one coil are input to the driving circuit 150, the driving circuit 150 may supply a current to at least one selected coil and heat the vessel to a selected output level through the at least one selected coil.

The driving circuit 150 adjusts a magnitude of the current applied to the coil on the basis of an output level selection signal of the coil.

Here, the output level is obtained by discretely dividing an intensity of the magnetic field B generated by each of the coils 141, 142, 143, and 144. As the output level increases, the coil may generate a large magnetic field B and allow the vessel 200 to be more rapidly heated at a higher temperature.

When the position selection signal of the coil is transmitted to the driving circuit 150, the driving circuit 150 may recognize a time point at which the position selection signal of the coil is transmitted thereto as an operation start time point, and supply a current to the coil. When the output level selection signal is transmitted to the driving circuit 150, the driving circuit 150 may recognize a time point at which the output level selection signal is transmitted thereto as the operation start time point, and supply the current to the coil.

The cooking apparatus 100 may further include a temperature detector (not illustrated) provided around each of the plurality of coils. In this case, the driving circuit 150 may adjust a magnitude of the current applied to the coil on the basis of a detected temperature.

The driving circuit 150 will be described with reference to FIG. 5.

Figure 5A:
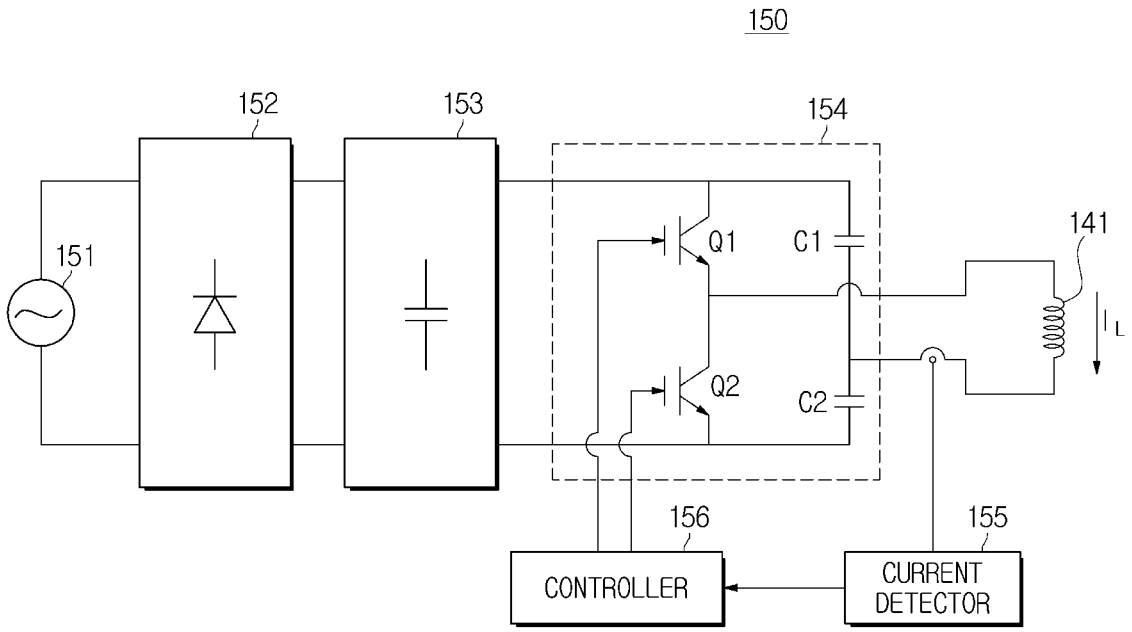
FIG. 5A is a detailed configuration diagram of a driving circuit provided in the cooking apparatus according to the embodiment.
Figure 5B:
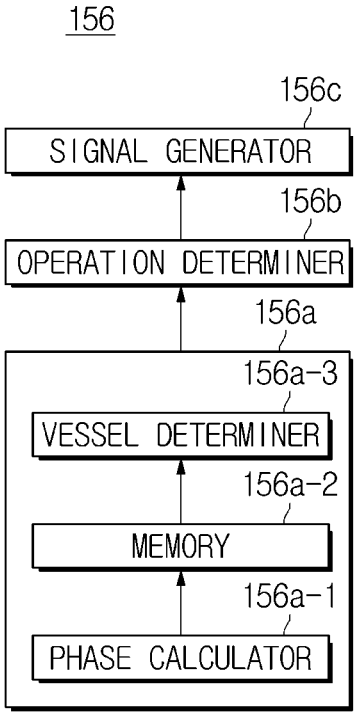
FIG. 5B is a detailed configuration diagram of a controller provided in the cooking apparatus according to the embodiment.

FIG. 5A is a detailed configuration diagram of a driving circuit provided in the cooking apparatus according to the embodiment, FIG. 5B is a detailed configuration diagram of a controller provided in the cooking apparatus according to the embodiment, and FIG. 5C is a view illustrating an example of a vessel determination of the cooking apparatus according to the embodiment.

As illustrated in FIG. 5A, the driving circuit 150 includes a power supply 151, a rectifier 152, a smoother 153, a driver 154, a current detector 155, a controller 156, and a storage 157.

The power supply 151 is connected to an external commercial power supply and receives power from the external commercial power supply.

The power supply 151 includes a power switch. When a power-on signal is transmitted to the power supply 151 through the inputter 131, the power supply 151 turns the power switch on to be connected to the external commercial power supply.

The power supply 151 may filter noise from power of the external commercial power supply and then transmit the power to the rectifier 152.

The rectifier 152 receives the power from the power supply 151, rectifies the received power, and transmits the rectified power to the smoother 153.

The rectifier 152 may include at least one diode and may include a bridge diode.

The smoother 153 filters a ripple of the power rectified by the rectifier 152 and transmits the power to the driver 154.

That is, the smoother 153 converts the power into a direct current by filtering a pulsating current from the applied power and transmits power of the converted DC to the driver 154 as a driving power thereof.

When power is supplied from the smoother 153, the driver 154 supplies the supplied power to at least one coil.

Here, the number of drivers 154 may be equal to the number of coils.

For example, when one coil is provided in the cooking apparatus, one driver is provided. When four coils are provided in the cooking apparatus, four drivers are provided.

When a plurality of drivers 154 are provided in the cooking apparatus, a plurality of drivers may be connected to a plurality of coils and may supply power to the coils connected thereto.

That is, the plurality of drivers independently operate on the basis of the position selection signal of the coil.

Since configurations of the drivers connected to the coils are the same, a driver connected to the first coil 141 will be described as an example in the present embodiment.

The driver 154 includes a first switch Q1 and a second switch Q2, which are connected between both terminals of the smoother 153 and receive an operation signal from the controller 156, and a first capacitor C1 and a second capacitor C2, which are connected between both terminals of the smoother 153.

Each of the first switch Q1 and the second switch Q2 may include a gate terminal connected to the controller 156 and may be turned on by receiving a turn-on signal through the gate terminal or turned off by receiving a turn-off signal through the gate terminal.

Here, the first switch Q1 and the second switch Q2 may be alternately turned on. That is, when the first switch Q1 is turned on, the second switch Q2 may be turned off, and when the first switch Q1 is turned off, the second switch Q2 may be turned on.

The driver 154 may be provided in the form of a half bridge.

The first and second capacitors C1 and C2 may be connected in parallel to the pair of the first switch Q1 and the second switch Q2.

One terminal of the first coil 141 of the coil part 140 may be connected to a node to which the pair of switches Q1 and Q2 are connected in series and the other terminal thereof may be connected to a node to which the pair of capacitors C1 and C2 are connected in series.

The first coil 141 forms a resonant circuit with the first and second capacitors C1 and C2.

A current $I_L$ of the first coil 141 resonates at a predetermined cycle.

Here, the predetermined cycle may be determined according to time constants of the first coil and the first and second capacitors.

The first coil 141 generates a high frequency magnetic field using operating frequencies of the first switch Q1 and the second switch Q2.

The driver 154 may supply a current, whose direction is changed, to the first coil 141 according to turn-on and turn-off operations of each of the first switch Q1 and the second switch Q2.

That is, when the first switch Q1 is turned on and the second switch Q2 is turned off, a driving current in a first direction is supplied to the first coil 141, and when the first switch Q1 is turned off and the second switch Q2 is turned on, a driving current in a second direction is supplied to the first coil 141.

The current detector 155 is connected to the first coil 141, detects a current flowing through the first coil 141, and transmits information on the detected current to the controller 156.

For example, the current detector 155 may include a current transformer (CT) configured to reduce a current in proportion to a magnitude of the current supplied to the first coil 141 and an ampere meter configured to detect a magnitude of the proportionally reduced current.

In another example, the current detector 155 may include a shunt resistor connected to the first coil 141 and a measurement part (not illustrated) configured to measure a voltage drop occurring in the shunt resistor.

The driving circuit 150 may further include a gate driver (not illustrated) configured to generate gate signals for turning the first switch Q1 and the second switch Q2 on and off according to commands of the controller 156.

Here, the gate driver may be provided integrally with the controller 156 or separately from the controller 156.

When the gate driver is provided separately from the controller, the controller 156 may include a communication interface for communication with the gate driver.

When an output level selection signal and position selection information of a coil are transmitted to the controller 156, the controller 156 transmits a control signal to the driver 154 to supply a current corresponding to the selected output level to the selected coil.

When the controller 156 transmits the control signal to the driver 154, the controller 156 transmits a control signal for alternately controlling turn-on operations of the first switch and the second switch to the driver 154.

The controller 156 may change a magnitude of the current supplied to the first coil 141 by changing cycles of the turn-on and turn-off operations of the first switch Q1 and the second switch Q2 to apply the current corresponding to the selected output level to the first coil 141.

Here, the cycles of the turn-on and turn-off operations of the first switch Q1 and the second switch Q2 may be determined according to a frequency.

The controller 156 may control pulse-width modulation (PWM) of the turn-on and turn-off operations of the first and second switches on the basis of a temperature of the coil.

When the operation start signal is transmitted to the controller 156, the controller 156 performs noise reduction control during a reference time, and when the reference time elapses, the controller 156 performs vessel material determination control during a setting time.

When the operation start signal is transmitted to the controller 156, the controller 156 performs the noise reduction control during the reference time from a time point at which the operation start signal is transmitted thereto, and when the reference time elapses, the controller 156 performs the vessel material determination control during the setting time from a time point at which the reference time elapses.

The controller 156 gradually increases a duty cycle of the first switch from a first duty cycle D1 to a second duty cycle D2 during the reference time from the time point at which the operation start signal is transmitted thereto, so that a turn-on time of the first switch is gradually increased during the reference time.

The controller 156 may increase the duty cycle at a predetermined rate when the duty cycle of the first switch is gradually increased.

Here, the number of times the duty cycle which is gradually increased between the first duty cycle and the second duty cycle may be one or more.

The controller 156 may control the time of the turn-on operation of the first switch during the reference time on the basis of the first duty cycle without increasing the duty cycle between the first duty cycle and the second duty cycle, change the duty cycle of the first switch to the second duty cycle, and then control the turn-on time of the first switch on the basis of the second duty cycle.

As described above, the controller 156 may control the current applied to the first coil during the reference time to prevent the current from being excessively applied to the first coil in a short time and minimize noise generated around the first coil when an operation of the cooking apparatus is started.

Here, the operation start signal may include at least one of a coil position selection signal, an output level selection signal, and an operation start button signal.

The reference time is a time from a time point at which the first switch is operated at the first duty cycle to a time point at which the first switch is operated at the second duty cycle.

The duty cycle of the first switch is a ratio of the turn-on time of the first switch to a time of one cycle.

The first duty cycle is a ratio of a minimum turn-on time, during which the first switch is turned on, to the time of one cycle, and the second duty cycle is 50% of the first duty cycle, which is a ratio of half of the turn-on time to the time of one cycle.

The controller 156 allows a current in the first direction to be applied to the first coil during a turn-on time corresponding to the duty cycle of the first switch Q1, and, in this case, controls the second switch Q2 to be turned off.

The controller 156 allows a current in the second direction opposite to the first direction to be applied to the first coil during a turn-on time corresponding to the duty cycle of the second switch Q2, and, in this case, controls the first switch Q1 to be turned off.

The current stored in the first coil 141 during the turn-on time of the first switch decreases during the turn-on time of the second switch.

The controller 156 operates the first switch and the second switch on the basis of a plurality of different operating frequencies when the noise reduction control is completed, and determines a material of a vessel on the basis of the current of the coil detected at this time.

The controller 156 applies signals with a plurality of frequencies having different sizes to the first switch and the second switch at predetermined time intervals and compares a phase of each of currents which are detected while the first switch and the second switch operate to a phase of a voltage when the first switch is turned on to determine the material of the vessel.

More specifically, the controller 156 checks a zero cross point of the detected current for each of the plurality of frequencies and compares a phase at a starting time point of the zero cross point for each of the operating frequencies to a phase at a starting time point of the turn-on operation of the first switch for each of the operating frequencies to determine the material of the vessel. When the vessel is determined to be a non-heatable vessel, the controller 156 blocks the applied current or controls an output of non-heatable information.

When the vessel is determined to be a non-heatable vessel, the controller 156 may determine that there is no vessel on the coil and control the current applied to the coil to be blocked.

The controller 156 applies signals with the plurality of frequencies having different sizes to the first switch and the second switch at the predetermined time intervals, checks the currents which are detected while the first switch and the second switch operate, checks the zero cross point of the detected current for each of the plurality of frequencies, and compares the phase at the starting time point of the zero cross point for each of the operating frequencies to the phase at the starting time point of the turn-on operation of the first switch for each of the operating frequencies to determine the material of the vessel. When the vessel is determined to be a non-heatable vessel, the controller 156 blocks the applied current or controls the output of the non-heatable information.

The controller 156 determines that the vessel is a non-heatable vessel when a phase difference with respect to any one frequency is greater than or equal to a reference phase difference, and determines that the vessel is a heatable vessel when the phase difference is smaller than the reference phase difference.

The controller 156 may compare the starting time point of the zero cross point for each of the operating frequencies to the starting time point of the turn-on operation of the first switch for each of the operating frequencies to determine the material of the vessel.

Here, the plurality of different operating frequencies may include two to ten frequencies having different frequency magnitudes.

When the plurality of different operating frequencies include three or more frequencies, the plurality of different operating frequencies are applied to the first switch and the second switch in order of the magnitudes of the frequencies.

The controller 156 obtains a phase difference between the phase at the starting time point of the turn-on operation of the first switch for each of the operating frequencies and the phase at the zero cross point of the current of the coil and compares the phase differences of the operating frequencies to determine the material of the vessel.

The controller 156 determines that the vessel is a non-heatable vessel when an amount of change of the phase difference is greater than or equal to a reference phase difference amount of change, and determines that the vessel is a heatable vessel when the amount of change of the phase difference is smaller than the reference phase difference amount of change.

The controller 156 may check the amount of change of the phase difference between the different operating frequencies and determine the material of the vessel on the basis of the checked amount of change.

When the number of the plurality of operating frequencies is three or more, the controller 156 may list phase differences of the operating frequencies in order of magnitude, check an amount of change of a phase difference between adjacent operating frequencies, and determine the material of the vessel on the basis of the checked amount of change.

When the operation start signal is transmitted to the controller 156, the controller 156 may apply the plurality of different operating frequencies to the first switch and the second switch at the predetermined time intervals, check a peak current of the detected currents for each of the operating frequencies, and compare amount of changes of the peak currents of the operating frequencies to determine the material of the vessel.

The controller 156 determines that the vessel is a non-heatable vessel when the amount of change of the peak current is greater than or equal to a reference current amount of change, and determines that the vessel is a heatable vessel when the amount of change of the peak current is smaller than the reference current amount of change.

When the operation start signal is transmitted to the controller 156, the controller 156 may apply an operating frequency to the first switch and the second switch, check a peak current of currents which are detected when the operating frequency is applied to the switches, and determine the material of the vessel on the basis of the checked peak current.

When the operating frequency is applied to the controller 156, the controller 156 determines that the vessel is a non-heatable vessel when the peak current of the first coil is greater than or equal to a reference current, and determines that the vessel is a heatable vessel when the peak current of the first coil is smaller than the reference current.

The controller 156 may determine the material of the vessel on the basis of a root mean square (RMS) current instead of the peak current.

As illustrated in FIG. 5B, the controller 156 may include a vessel determination algorithm part 156*a* configured to determine a material of a vessel, an operation determiner 156*b* configured to determine whether a coil operates, and a signal generator 156*c* configured to operate the first and second switches. The vessel determination algorithm part 156*a* may include a phase calculator 156*a*-1, a memory 156*a*-2, and a vessel determiner 156*a*-3.

The phase calculator 156*a*-1 of the vessel determination algorithm part 156*a* compares a phase at a time point of the zero cross point of the current detected for each of the operating frequencies to a phase at the starting time point of the turn-on operation of the first switch for each of the operating frequencies to obtain a phase difference for each of the operating frequencies.

The memory 156*a*-2 is configured to store the phase difference for each of the operating frequencies.

The memory 156*a*-2 may be configured to store a table for determining whether the vessel is placed on the coil.

As illustrated in FIG. 5C, the table includes comparison information between an amount of change of a phase difference to a reference phase difference amount of change as a determination criterion, and information on the presence or absence of a vessel as determination information.

That is, in the case in which the amount of change of the phase difference among determination criteria in the table is smaller than the reference phase difference amount of change, the determination criterion matches the presence of the vessel, and in the case in which the amount of change of the phase difference among the determination criteria in the table is greater than or equal to the reference phase difference amount of change, the determination criterion matches the absence of the vessel.

Here, the absence of the vessel may mean that a non-heatable vessel (e.g., an aluminum vessel, a glass vessel, etc.) is placed on the coil.

The vessel determiner 156*a*-3 compares the phase differences of the operating frequencies to determine whether the material of the vessel is heatable or non-heatable.

When the vessel is determined to be a heatable vessel, the operation determiner 156*b* checks a current to be applied to the coil on the basis of an output level and checks a frequency corresponding to the checked current.

The signal generator 156*c* generates a plurality of different operating frequencies for determining the material of the vessel and applies the plurality of different operating frequencies to each gate terminal of the first switch and the second switch.

The signal generator 156*c* generates a frequency corresponding to an output level for heating the vessel and applies the frequency to each of the gate terminals of the first switch and the second switch.

The signal generator 156*c* generates an operation signal of the first switch for noise reduction control. In this case, the signal generator 156*c* may generate a signal whose duty cycle is gradually increased.

The storage 157 is configured to store the first duty cycle and the second duty cycle.

The storage 157 may be configured to further store a plurality of increasing duty cycles between the first duty cycle and the second duty cycle.

The storage 157 may be configured to store a predetermined rate for gradually increasing the duty cycle from the first duty cycle to the second duty cycle.

The storage 157 is configured to store a reference phase difference and the reference phase difference amount of change.

The storage 157 may be configured to store a reference peak current and a reference peak current amount of change.

The storage 157 may be configured to store a reference time for reducing noise and a setting time for determining a material of a vessel.

The storage 157 is configured to store an output level for each of the coils, a magnitude of a current corresponding to each of the output levels, and a frequency corresponding to the magnitude of the current.

That is, the storage 157 may be configured to store a lookup table in which the output level, the magnitude of the current corresponding to the output level, and the frequency corresponding to the magnitude of the current match each other.

When capacities of the plurality of coils are different, the lookup table may be provided for each of the coils.

The controller may include a memory (not illustrated) configured to store algorithms for controlling operations of components or data for programs which implement the algorithms, and a processor (not illustrated) configured to perform the above-described operations using the data stored in the memory. In this case, the memory and the processor may be implemented as separate chips. Alternatively, the memory and the processor may be implemented as a single chip.

The storage may be implemented as at least one of a non-volatile memory device, such as a cache memory, a read-only memory (ROM), a programmable ROM (PROM), an erasable PROM (EPROM), an electrically erasable PROM (EEPROM), and flash memory, a volatile memory device such as a random access memory (RAM), or storage medium, such as a hard disk drive (HDD) and a compact disc ROM (CD-ROM), but the present disclosure is not limited thereto. The storage may be a memory implemented as a chip separated from the above-described processor in connection with the controller, and may be implemented as a single chip with the processor.

Figure 6:
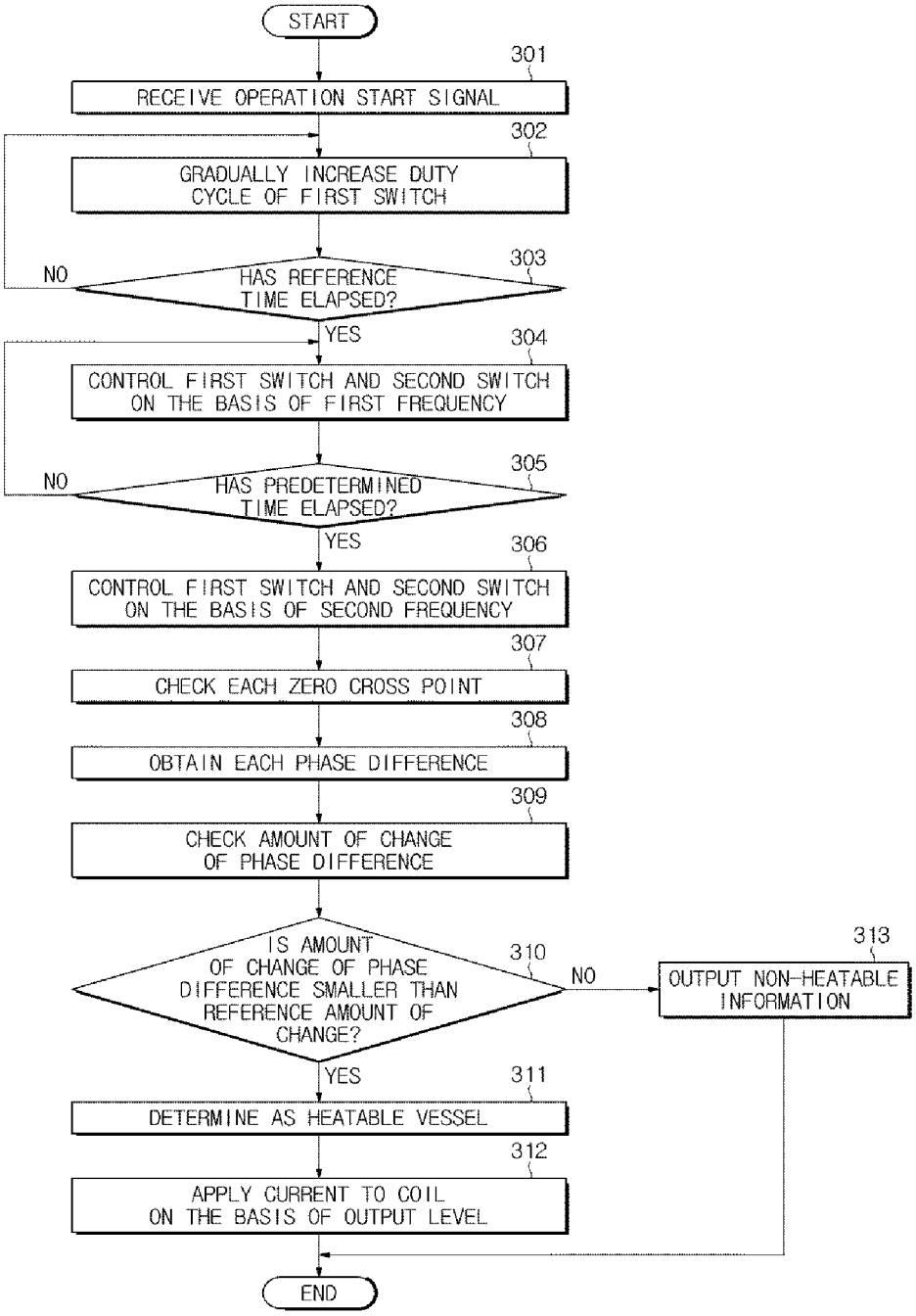
FIG. 6 is a control flowchart of the cooking apparatus according to the embodiment.

FIG. 6 is a control flowchart of the cooking apparatus according to the embodiment and will be described with reference to FIGS. 7 to 13.

When an operation start signal is transmitted to the cooking apparatus, the cooking apparatus performs noise reduction control during a reference time from a time point at which the operation start signal is transmitted thereto, and when the reference time elapses, the cooking apparatus performs vessel material determination control during a setting time from a time point at which the reference time has elapsed.

This process will be described with reference to FIG. 7. An example of an operation of a first coil among a plurality of coils will be described.

Figure 7:
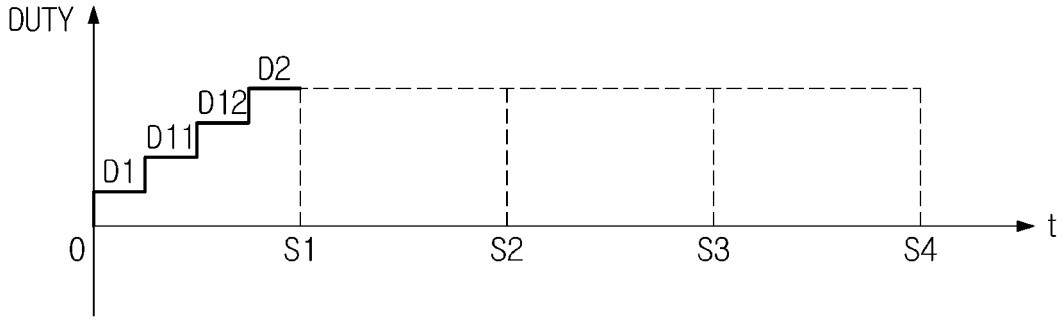
FIG. 7 is a view illustrating an example of a control time of the cooking apparatus according to the embodiment.

FIG. 7 is a view illustrating an example of a control time of the cooking apparatus according to the embodiment.

When an operation start signal is transmitted to the cooking apparatus, the cooking apparatus performs noise reduction control during a reference time s1 from a time point s0 at which the operation start signal is transmitted thereto, and when the reference time s1 elapses, the cooking apparatus applies a plurality of operating frequencies having different magnitudes to the first and second switches from a time point at which the reference time s1 has elapsed to a setting time s4 at predetermined time intervals and determines a material of a vessel.

In the noise reduction control, when the operation start signal is transmitted to the cooking apparatus (301), the cooking apparatus gradually increases a duty cycle of the first switch Q1 from the first duty cycle D1 to the second duty cycle D2 during the reference time s1 from the time point s0 at the operation start signal is transmitted thereto (302) and allows a current of the first coil to be gradually increased according to a change of the duty cycle of the first switch Q1.

Here, the first duty cycle D1 is a minimum duty cycle in which the first switch can operate, and the second duty cycle D2 is a duty cycle when the duty cycle of the first switch is 50%.

This process will be described in more detail.

The cooking apparatus controls a turn-on operation of the first switch on the basis of the first duty cycle when the duty cycle of the first switch is gradually increased. The cooking apparatus controls a turn-off operation of the first switch when a turn-on time of the first switch elapses and controls the turn-on operation of the first switch on the basis of a first increasing duty cycle D11 which is increased by a predetermined rate from the first duty cycle when a turn-off time of the first switch elapses.

In the case in which the cooking apparatus controls the turn-on operation of the first switch on the basis of the first increasing duty cycle D11, the cooking apparatus controls the turn-off operation of the first switch when the turn-on time of the first switch elapses and controls the turn-on operation the first switch on the basis of a second increasing duty cycle D12 which is increased by a predetermined rate from the first increasing duty cycle D11 when the turn-off time of the first switch elapses.

In the case in which the cooking apparatus controls the turn-on operation of the first switch on the basis of the second increasing duty cycle D12, the cooking apparatus controls the turn-off operation of the first switch when the turn-on time of the first switch elapses and controls the turn-on operation of the first switch on the basis of the second duty cycle D2 which is increased by a predetermined rate from the second increasing duty cycle D12 when the turn-off time of the first switch elapses.

The cooking apparatus completes the noise reduction control when the duty cycle of the first switch is the second duty cycle D2.

That is, the cooking apparatus completes the noise reduction control when the reference time s1 elapses from the time point s0 when the operation start signal is transmitted thereto.

Here, a control cycle of the first switch corresponding to the first duty cycle, a control cycle of the first switch corresponding to the first increasing duty cycle, a control cycle of the first switch corresponding to the second increasing duty cycle, and a control cycle of the first switch corresponding to the second duty cycle may be the same.

The cooking apparatus may control the turn-on time of the first switch on the basis of the first duty cycle, change the duty cycle of the first switch to the second duty cycle, and then control the turn-on time of the first switch on the basis of the second duty cycle without controlling the increasing duty cycle between the first duty cycle and the second duty cycle.

As described above, the cooking apparatus may control the current applied to the first coil during the reference time to prevent the current from being excessively applied to the first coil in a short time and minimize noise generated around the first coil when an operation of the cooking apparatus is started.

This process will be described with reference to FIG. 8.

Figure 8:
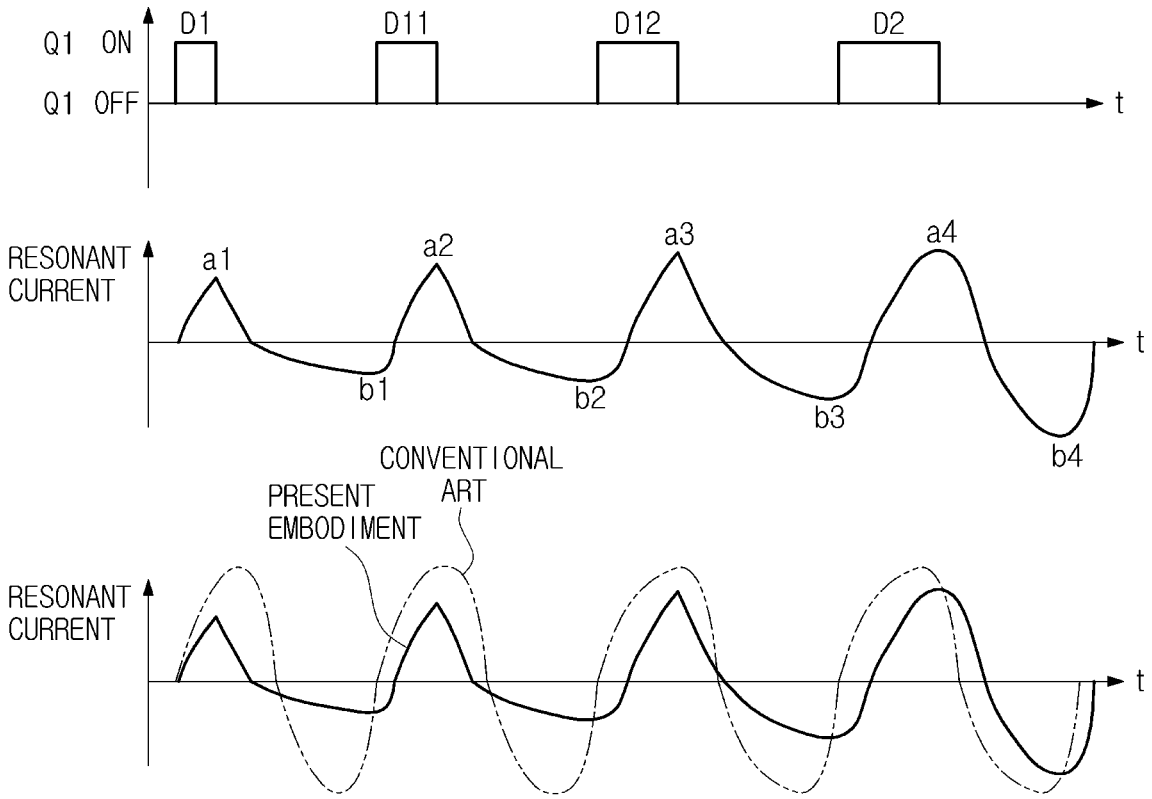
FIG. 8 is a graph of a current of the cooking apparatus according to the embodiment during noise reduction control.

FIG. 8 is a graph of a current of the cooking apparatus according to the embodiment during the noise reduction control.

When the first switch is turned on during a turn-on time corresponding to the first duty cycle D1, a current in a first direction flows through the first coil, and when the first switch is turned off during a turn-off time corresponding to the first duty cycle D1, a current in a second direction flows through the first coil.

In this case, it can be seen that a peak current of the current in the first direction flowing through the first coil may be a1, and a peak current of the current in the second direction and flowing through the first coil may be b1.

Here, an amount of the current of the first coil during the turn-on time may be the same as that of the current of the first coil during the turn-off time. A difference between the amounts of the two currents may be within a reference error.

When the first switch is turned on during a turn-on time corresponding to a first increasing duty cycle D11, a current in the first direction flows through the first coil, and when the first switch is turned off during a turn-off time corresponding to the first increasing duty cycle D11, a current in the second direction flows through the first coil.

In this case, it can be seen that a peak current of the current in the first direction flowing through the first coil may be a2, and a peak current of the current in the second direction flowing through the first coil may be b2.

When the first switch is turned on during a turn-on time corresponding to a second increasing duty cycle D12, a current in the first direction flows through the first coil, and when the first switch is turned off during a turn-off time corresponding to the second increasing duty cycle D12, a current in the second direction flows through the first coil.

In this case, it can be seen that a peak current of the current in the first direction flowing through the first coil may be a3, and a peak current of the current in the second direction flowing through the first coil may be b3.

When the first switch is turned on during a turn-on time corresponding to a second duty cycle D2, a current in the first direction flows through the first coil, and when the first switch is turned off during a turn-off time corresponding to the second duty cycle D2, a current in the second direction flows through the first coil.

In this case, it can be seen that a peak current of the current in the first direction flowing through the first coil may be a4, and a peak current of the current in the second direction flowing through the first coil may be b4.

As described above, it can be seen that the peak currents in the first direction flowing through the first switch and the peak currents in the second direction flowing through the first coil are gradually increased as the duty cycle of the first coil is increased.

Specifically, conventionally, the first switch is operated at a 50% duty cycle from an operation start time point of the cooking apparatus. Accordingly, it can be seen that an excessive current flows through the coil from the operation start time point in a short time.

Conversely, in the present embodiment, it can be seen that the currents applied to the first coil are gradually increased by gradually increasing the duty cycle of the first switch when the operation is started.

The increasing of the duty cycle of the first switch may include increasing the duty cycle multiple times and may include an increase rate corresponding to each of the plurality of increasing duty cycles.

Accordingly, the cooking apparatus may gradually increase the duty cycle from the first duty cycle to the second duty cycle on the basis of the increase rate corresponding to each of the plurality of increasing duty cycles.

For example, the first increasing duty cycle of the cooking apparatus may include a 10% increase rate, and the second increasing duty cycle may include a 20% increase rate.

In this case, the cooking apparatus may control an operation of the first switch with the first increasing duty cycle, which is increased by 10% from the first duty cycle, after controlling the operation of the first switch with the first duty cycle, and then control the operation of the first switch with the second increasing duty cycle, which is increased by 20% from the first increasing duty cycle.

The increase rate of each of the plurality of increasing duty cycles of the cooking apparatus may be a predetermined rate.

For example, when the predetermined rate is 10%, the cooking apparatus may control the operation of the first switch with the first increasing duty cycle, which is increased by 10% from the first duty cycle, after controlling the operation of the first switch with the first duty cycle, and then control the operation of the first switch with the second increasing duty cycle, which is increased by 10% from the first increasing duty cycle.

When a reference time elapses (303), the cooking apparatus determines a material of a vessel until the setting time s4. In this case, the cooking apparatus controls the operations of the first and second switches on the basis of a plurality of operating frequencies having different magnitudes at predetermined time intervals.

Here, a time point at which the reference time has elapsed is a time point at which the noise reduction control is completed.

The plurality of operating frequencies may include a first operating frequency and a second operating frequency smaller than the first operating frequency.

The plurality of operating frequencies may include ten operating frequencies having different magnitudes.

When the plurality of operating frequencies are three operating frequencies, the cooking apparatus applies the first operating frequency to the first and second switches during a predetermined time from a time point s1 at which the reference time has elapsed, applies the second operating frequency to the first and second switches during a predetermined time from a time point s2 at which the predetermined time has elapsed, applies the third operating frequency to the first and second switches during a predetermined time from a time point s3 at which the predetermined time has elapsed, and completes the vessel material determination control when a predetermined time elapses (see FIG. 7).

The vessel material determination control of the cooking apparatus will be described in more detail.

In addition, an example in which two operating frequencies are used to determine a material of a vessel will be described.

That is, the plurality of operating frequencies includes the first operating frequency and the second operating frequency smaller than the first operating frequency.

The cooking apparatus controls the operations of the first switch and the second switch for a predetermined time on the basis of the first operating frequency (304). In this case, the duty cycle of each of the first and second switches may be 50%, and the first switch and the second switch may be alternately turned on.

Here, the control of the first and second switches for the predetermined time means that the first and second switches are controlled using the first operating frequency during a plurality of cycles.

When the first switch and the second switch are operated using the first operating frequency for the predetermined time, the cooking apparatus checks a starting time point of a turn-on operation of the first switch for each cycle and detects a current flowing through the first coil.

When the predetermined time elapses (305), the cooking apparatus controls the operations of the first switch and the second switch for the predetermined time on the basis of the second operating frequency (306). In this case, the duty cycle of each of the first and second switches may be 50%, and the first switch and the second switch may be alternately turned on.

Here, the control of the first and second switches for the predetermined time means that the first and second switches are controlled using the second operating frequency during a plurality of cycles.

When the first switch and the second switch are operated using the second operating frequency for the predetermined time, the cooking apparatus checks a starting time point of the turn-on operation of the first switch for each cycle and detects a current flowing through the first coil.

The current detected when the first and second switches are operated using the first operating frequency for the predetermined time may be detected as having a current waveform having a plurality of cycles.

The current detected when the first and second switches are operated using the second operating frequency for the predetermined time may be detected as having a current waveform having a plurality of cycles.

The number of the plurality of cycles of the first operating frequency may be the same as that of the plurality of cycles of the second operating frequency.

Figure 9:
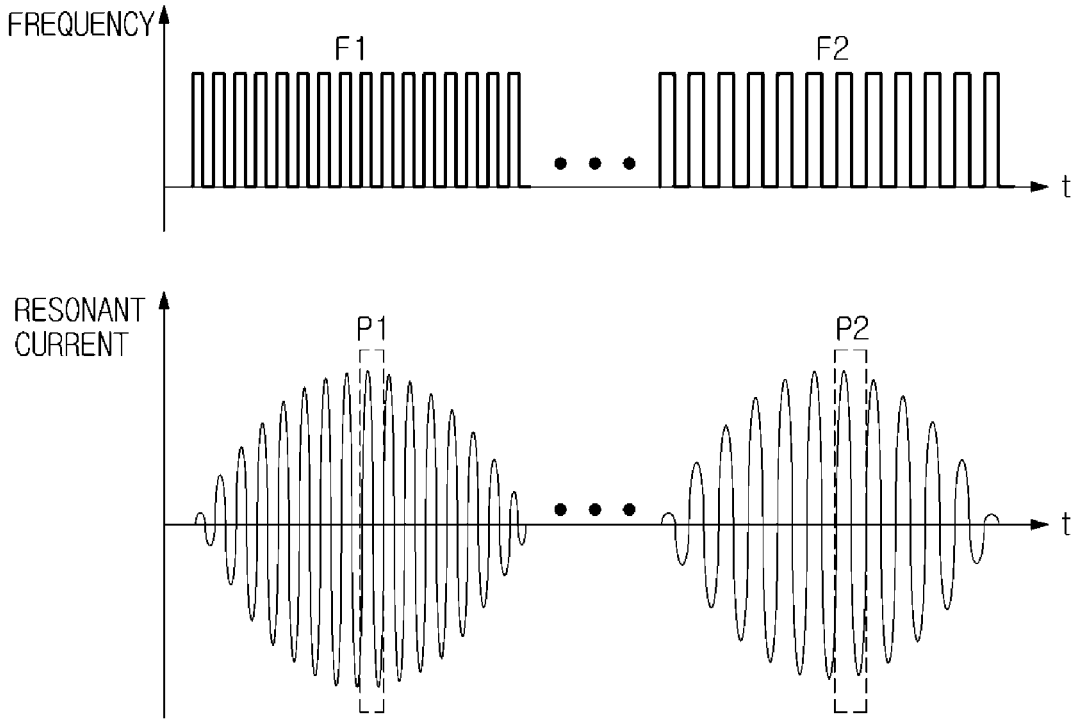
FIG. 9 is a view illustrating an example of a current waveform of the cooking apparatus according to the embodiment for each operating frequency.

As illustrated in FIG. 9, an amplitude of a waveform P1 of the current flowing through the first coil when the first switch and the second switch are operated using a first operating frequency F1 for the predetermined time may be changed by overlapping a frequency obtained by turning-on or turning-off each of the first and second switches with a resonant frequency of a resonant circuit (i.e., the first coil and the first and second capacitors).

When the first switch and the second switch operate using a second operating frequency F2 during the predetermined time, an amplitude of a waveform P2 flowing through the first coil may be changed by overlapping the frequency obtained by turning-on or turning-off each of the first and second switches with the resonant frequency of the resonant circuit (i.e., the first coil and the first and second capacitors).

Accordingly, the cooking apparatus obtains a current waveform of one cycle having the maximum amplitude among waveforms of the current flowing through the first coil when the first switch and the second switch are operated by the first operating frequency and checks a first zero cross point ZCP1 of the obtained current waveform of one cycle (307).

The cooking apparatus obtains a current waveform of one cycle having the maximum amplitude among the waveforms of the current flowing through the first coil when the first switch and the second switch are operated using the second operating frequency and checks a second zero cross point ZCP2 of the obtained current waveform of one cycle (307).

Next, the cooking apparatus checks a starting time point of a turn-on operation of the first switch corresponding to the current waveform of one cycle having the maximum amplitude, and obtains a first phase difference between a phase at the checked starting time point of the turn-on time (i.e., a phase of a voltage) and a phase at a starting time point of the first zero cross point ZCP1 (i.e., a phase of a current) (308).

The cooking apparatus checks the starting time point of the turn-on operation of the first switch corresponding to the current waveform of one cycle having the maximum amplitude and obtains a second phase difference between a phase at the checked starting time point of the turn-on time (i.e., a phase of a voltage) and a phase at the starting time point of the second zero cross point ZCP2 (i.e., a phase of a current) (308).

This process will be described with reference to FIGS. 10 and 11.

Figure 10:
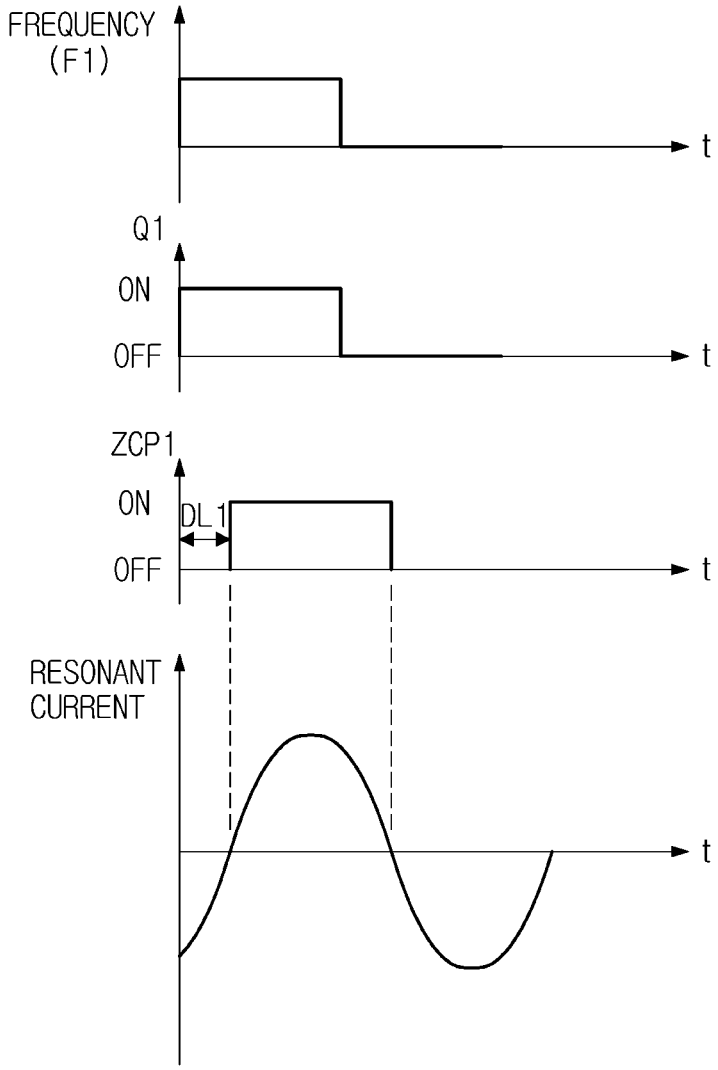
FIG. 10 is a view illustrating an example of a phase of the cooking apparatus according to the embodiment with respect to a first operating frequency.
Figure 11:
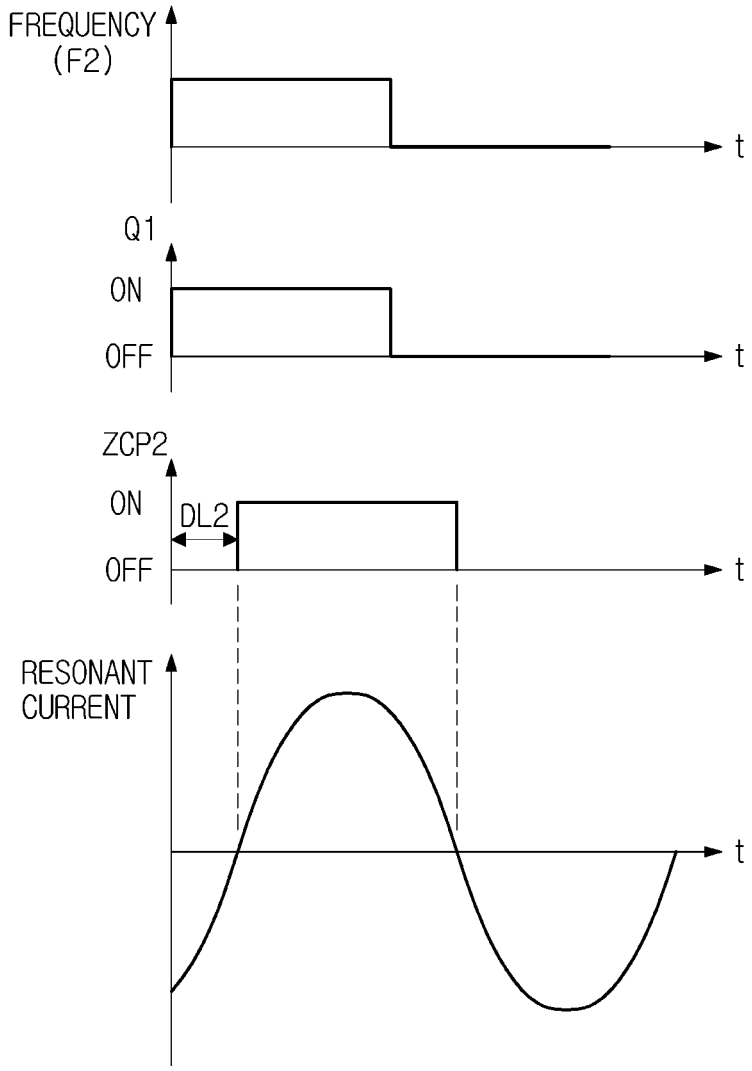
FIG. 11 is a view illustrating an example of a phase of the cooking apparatus according to the embodiment with respect to a second operating frequency.

FIG. 10 is a view illustrating an example of a phase of the cooking apparatus according to the embodiment with respect to a first operating frequency, and FIG. 11 is a view illustrating an example of a phase of the cooking apparatus according to the embodiment with respect to a second operating frequency.

As illustrated in FIG. 10, the cooking apparatus controls the turn-on operations of the first and second switches using the first operating frequency F1.

That is, the cooking apparatus turns on the first switch Q1 during a half cycle of the first operating frequency F1 and turns off the first switch Q1 during the remaining half cycle of the first operating frequency. When the first switch Q1 is turned off, the second switch Q2 is turned on.

The cooking apparatus checks a current waveform of one cycle having the maximum amplitude among detected waveforms of a current when the first and second switches are operated using the first operating frequency, checks a turn-on time of the first switch Q1 corresponding to the obtained current waveform of one cycle, and checks a phase of a voltage at the checked starting time point of the turn-on operation of the first switch.

The cooking apparatus checks the first zero cross point ZCP1 in the obtained current waveform of one cycle and compares a phase of the current at the checked starting time point of the first zero cross point ZCP1 to the phase of the voltage at the checked starting time point of the turn-on operation of the first switch to obtain a first phase difference DL1.

As illustrated in FIG. 11, the cooking apparatus controls the turn-on operations of the first and second switches using the second operating frequency F2.

That is, the cooking apparatus turns on the first switch Q1 during a half cycle of the second operating frequency F2 and turns off the first switch Q1 during the remaining half cycle of the first operating frequency. When the first switch Q1 is turned off, the second switch Q2 is turned on.

The cooking apparatus checks a current waveform of one cycle having the maximum amplitude among detected waveforms of a current when the first and second switches operate by the second operating frequency, checks a turn-on time of the first switch Q1 corresponding to the obtained current waveform of one cycle, and checks a phase of a voltage at the checked starting time point of the turn-on operation of the first switch.

The cooking apparatus checks the first zero cross point ZCP1 in the obtained current waveform of one cycle and compares a phase of the current at the checked starting time point of the first zero cross point ZCP1 to the phase of the voltage at the checked starting time point of the turn-on operation of the first switch to obtain a second phase difference DL2.

Next, the cooking apparatus compares the first phase difference DL1 to the second phase difference DL2 to check an amount of change of a phase difference therebetween (309) and compares the checked amount of change of the phase difference to a reference phase difference amount of change to determine whether the checked amount of change of the phase difference is smaller than the reference phase difference amount of change (310).

When the checked amount of change of the phase difference is determined to be smaller than the reference phase difference amount of change, the cooking apparatus determines that the vessel is a heatable vessel (311) and applies a current to the first coil on the basis of an output level (312).

When the checked amount of change of the phase difference is determined to be greater than or equal to the reference phase difference amount of change, the cooking apparatus determines that the vessel is a non-heatable vessel and outputs non-heatable information through the display (313).

In the present embodiment, although the material of the vessel is described as being determined using operation information of the first switch, the material of the vessel may be determined using the operation information of the second switch.

The case in which the material of the vessel is iron and the case in which the material of the vessel is aluminum will be described as examples.

Electrical resistance of the vessel when the material of the vessel is iron is greater than that when the material of the vessel is aluminum. Therefore, a phase difference with respect to the same frequency when the material of the vessel is iron is smaller than that when the material of the vessel is aluminum, and an amount of change of the phase difference according to the change of the operating frequency when the material of the vessel is iron is smaller than that when the material of the vessel is aluminum.

Here, the reference phase difference amount of change is an amount of change for distinguishing a heatable vessel from a non-heatable vessel and is an experimentally obtained amount of change.

When the plurality of operating frequencies include first to fifth operating frequencies, the cooking apparatus checks a first phase difference with respect to the first operating frequency, a second phase difference with respect to the second operating frequency, a third phase difference with respect to the third operating frequency, a fourth phase difference with respect to the fourth operating frequency, and a fifth phase difference with respect to the fifth operating frequency, and checks amount of changes of the first to fifth phase difference according to the change of the operating frequencies to determine the material of the vessel.

The cooking apparatus may compare the first phase difference with respect to the first operating frequency to the second phase difference with respect to the second operating frequency to check an amount of change of the first phase difference, compare the second phase difference with respect to the second operating frequency to the third phase difference with respect to the third operating frequency to check an amount of change of the second phase difference, compare the third phase difference with respect to the third operating frequency to the fourth phase difference with respect to the fourth operating frequency to check an amount of change of the third phase difference, compare the fourth phase difference with respect to the fourth operating frequency to the fifth phase difference with respect to the fifth operating frequency to check an amount of change of the fourth phase difference, and then determine the material of the vessel on the basis of change trend between the amount of changes of the first to fourth phase differences.

In the present embodiment, although the material of the vessel is described as being determined on the basis of the amount of change of a phase difference between the operating frequencies, the material of the vessel may be determined on the basis of a phase difference between a voltage and a current when the first and second switches are operated using any one operating frequency, and the material of the vessel may be determined on the basis of a current of the coil when the first and second switches are operated using any one operating frequency.

The cooking apparatus may determine the material of the vessel on the basis of a difference of currents of the coil between the operating frequencies.

When the vessel is determined to be a heatable vessel, the cooking apparatus checks a current corresponding to an output level input to a user interface, checks an operating frequency corresponding to the checked current, and controls the operations of the first and second switches on the basis of the checked operating frequency.

This process will be described with reference to FIGS. 12 and 13.

Figure 12:
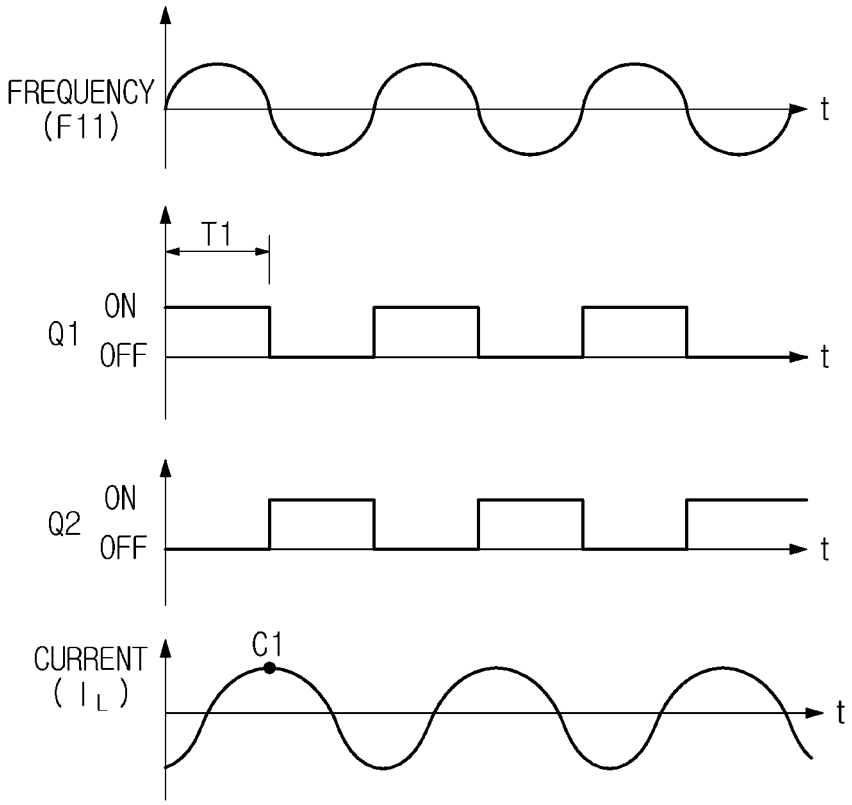
FIGS. 12 and 13 are views illustrating examples of current control corresponding to an output level of the cooking apparatus according to the embodiment.
Figure 13:
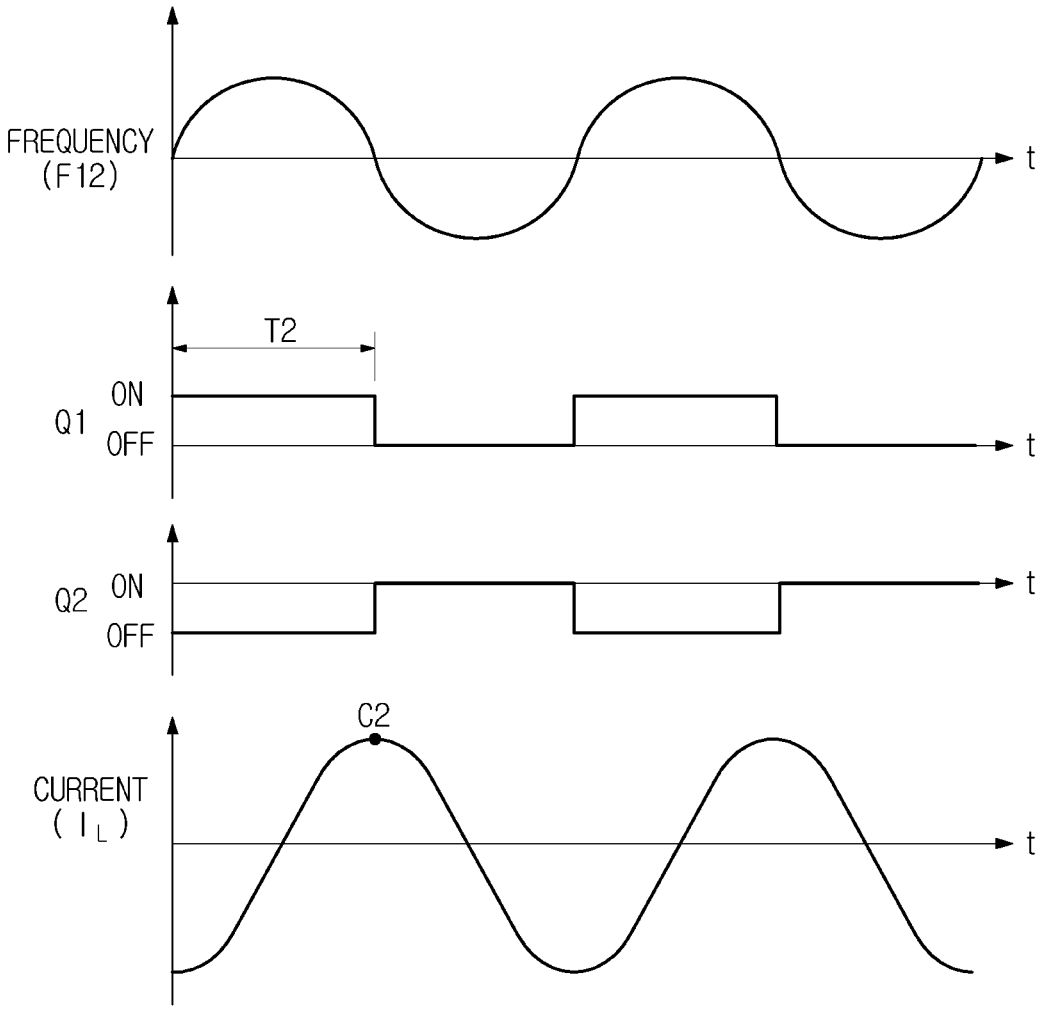

FIGS. 12 and 13 are views illustrating examples of current control corresponding to the output level of the cooking apparatus according to the embodiment.

As illustrated in FIG. 12, when an input output level is a first level, the cooking apparatus checks a current corresponding to the first level and checks a frequency corresponding to the checked current.

When the checked frequency is a first frequency F11, the cooking apparatus operates the first switch Q1 and the second switch Q2 on the basis of the first frequency F11.

Here, the first and second switches Q1 and Q2 operated using the first frequency F11 may have a duty cycle of T1.

The cooking apparatus turns on the first switch Q1 during a half cycle of the first frequency F11 and turns off the first switch Q1 during the remaining half cycle of the first frequency F11. When the first switch Q1 is turned off, the second switch Q2 is turned on.

A first current may flow through the first coil by the first and second switches Q1 and Q2 being operated on the basis of the first frequency F11, as described above.

As illustrated in FIG. 13, when the input output level is a second level, the cooking apparatus checks a current corresponding to the second level and checks a frequency corresponding to the checked current.

When the checked frequency is a second frequency F12 smaller than the first frequency, the cooking apparatus operates the first switch Q1 and the second switch Q2 on the basis of the second frequency F12.

Here, the first and second switches operated using the second frequency F12 may have a duty cycle of T2.

The cooking apparatus turns on the first switch Q1 during a half cycle of the second frequency F12 and turns off the first switch Q1 during the remaining half cycle of the second frequency F12. When the first switch Q1 is turned off, the second switch Q2 is turned on.

As described above, the cooking apparatus may allow a second current greater than the first current to flow through the first coil by increasing turn-on times of the first and second switches on the basis of the second frequency F12.

In addition, a peak C2 of the second current flowing through the first coil when the first and second switches Q1 and Q2 are operated on the basis of the second frequency F12 is higher than a peak C1 of the first current flowing through the first coil when the first and second switches Q1 and Q2 are operated on the basis of the first frequency F11.

As described above, the cooking apparatus may heat the vessel to a temperature corresponding to a user's requirement by adjusting the current flowing through the coil on the basis of an output level input by the user.

The disclosed embodiments may be implemented in the form of a recoding medium configured to store instructions executable by a computer. The instructions may be stored in the form of program codes. When the instructions are executed by a processor, the operations of the disclosed embodiments may be performed by a program module being generated thereby. The recoding medium may be implemented as a computer-readable recoding medium.

The computer-readable recoding medium includes all types of recording media in which instructions, which may be decoded by a computer, are stored. For example, examples of the computer-readable recoding medium may include a ROM, a RAM, a magnetic tape, a magnetic disk, a flash memory, an optical data storage device, and the like.

In the present disclosure, a duty cycle of at least one of the first and second switches is gradually increased to gradually increase a current applied to a coil, and thus noise caused by sudden application of a large current to the coil in an initial operation of a cooking apparatus can be minimized.

In the present disclosure, a misjudgment of a material of a vessel due to hardware set deviations of the cooking apparatus can be prevented by using two or more different operating frequencies.

That is, in the present disclosure, the material of a vessel is determined by comparing a phase at a zero cross point of a current of the coil to a phase at a starting time point of the turn-on operation of the switch for each of a plurality of operating frequencies, and thus determination accuracy of the material of the vessel can be improved.

The disclosed embodiments have been described above with reference to the accompanying drawings. It should be understood by those skilled in the art that the present disclosure may be embodied in forms different from the disclosed embodiments without departing from the scope of the present disclosure and without changing essential features thereof. The disclosed embodiments are only exemplary, and are not to be interpreted as limitative.

What is claimed is:

1. A cooking apparatus comprising:

a coil configured to generate a magnetic field when a current is applied to the coil;

a driver including a first switch and a second switch, and configured to change a direction of the applied current by alternately operating the first switch and the second switch;

a current detector configured to detect the current applied to the coil; and a controller configured to increase a duty cycle of the first switch from a first duty cycle to a second duty cycle for a predetermined time after an operation start signal is received by the controller, control operations of the first switch and the second switch based on an operating frequency when the predetermined time elapses, compare a phase of a voltage input to the first switch to a phase of the detected current, and determine a material of a vessel placed on the coil based on the comparison.

2. The cooking apparatus according to claim 1, wherein:

a half-cycle signal of one cycle signal of the operating frequency is a signal for turning on the first switch, and the remaining half-cycle signal is a signal for turning on the second switch; and the half-cycle signal for turning on the first switch has the second duty cycle.

3. The cooking apparatus according to claim 1, wherein the comparison includes comparing a phase of the voltage at a time point at which the first switch is turned on to a phase of a zero cross point of the detected current.

4. The cooking apparatus according to claim 3, wherein, when the vessel is determined to be a non-heatable vessel, the controller controls the current applied to the coil to be blocked and controls an output of non-heatable information of the vessel.

5. The cooking apparatus according to claim 4, wherein the controller controls the operations of the first switch and the second switch based on a different operating frequency from the operating frequency, rechecks a current detected while the first switch is operated using the different operating frequency and a starting time point of a turn-on operation of the first switch, compares a phase at a time point of a zero cross point of the rechecked current to a phase at the rechecked starting time point of the turn-on operation of the first switch, re-obtains a phase difference therebetween, and determines the material of the vessel based on the re-obtained phase difference and an amount of change of the obtained phase difference.

6. The cooking apparatus according to claim 5, wherein the controller determines that the vessel is a non-heatable vessel when the amount of change of the phase difference is greater than or equal to a predetermined phase difference amount of change, and determines that the vessel is a heatable vessel when the amount of change of the phase difference is smaller than the predetermined phase difference amount of change.

7. A cooking apparatus comprising:

a coil configured to generate a magnetic field when a current is applied to the coil;

a driver, including a first switch and a second switch, configured to change a direction of the applied current; and a controller configured to alternately control an operation of the first switch and the second switch during a predetermined time so that the current applied to the coil is increased after an operation start signal is received by the controller, wherein the controller gradually increases a duty cycle of the first switch during the predetermined time.

8. The cooking apparatus according to claim 7, wherein:

the controller controls the first switch so that a current in a first direction is applied to the coil during a turn-on time corresponding to the duty cycle of the first switch, and controls the second switch so that a current in a second direction opposite to the first direction is applied to the coil during a turn-on time corresponding to a duty cycle of the second switch; and the first switch is turned off while the second switch is turned on.

9. The cooking apparatus according to claim 7, further comprising a current detector configured to detect the current of the coil, wherein the controller changes operating frequencies for operating the first switch and the second switch at predetermined time intervals, checks a zero cross point of the detected current for each of the operating frequencies, compares a phase at the zero cross point for each of the operating frequencies to a phase at a starting time point of a turn-on operation of the first switch for each of the operating frequencies, determines a material of a vessel placed on the coil based on the comparison, and blocks the applied current when the vessel is determined to be a non-heatable vessel.

10. The cooking apparatus according to claim 9, wherein:

the operating frequencies changed at the predetermined time intervals include a first operating frequency and a second operating frequency smaller than the first operating frequency; and the controller compares the phase at the starting time point of the turn-on operation of the first switch to the phase at the zero cross point of the detected current when the operations of the first switch and the second switch are controlled based on the first operating frequency, obtains a first phase difference, compares the phase at the starting time point of the turn-on operation of the first switch to the phase at the zero cross point of the detected current when the operations of the first switch and the second switch are controlled based on the second operating frequency, obtains a second phase difference, and determines the material of the vessel based on an amount of change of a phase difference between the first phase difference and the second phase difference.

11. The cooking apparatus according to claim 10, wherein the controller determines that the vessel is a non-heatable vessel when the amount of change of the phase difference is greater than or equal to a predetermined phase difference amount of change and determines that the vessel is a heatable vessel when the amount of change of the phase difference is smaller than the predetermined phase difference amount of change.

12. The cooking apparatus according to claim 11, wherein the controller controls the first operating frequency and the second operating frequency to be generated in a plurality of cycles, obtains a first current waveform in one cycle of currents detected when the first operating frequency is generated in the plurality of cycles, obtains a second current waveform of one cycle of currents detected when the second operating frequency is generated in the plurality of cycles, and checks a zero cross point in each of the first current waveform and the second current waveform.

13. The cooking apparatus according to claim 10, wherein:

a half-cycle signal of one cycle signal of the operating frequency is a signal for turning on the first switch, and the remaining half-cycle signal is a signal for turning on the second switch; and a time for which the first switch is turned on is the same as a time for which the second switch is turned on.

14. The cooking apparatus according to claim 7, further comprising a current detector configured to detect the current of the coil, wherein the controller changes operating frequencies for operating the first switch and the second switch at predetermined time intervals, checks the detected current for each of the operating frequencies, compares the currents of the operating frequencies, and determines a material of a vessel placed on the coil based on the comparison.

* * * * *